US007625063B2

(12) United States Patent
White et al.

(10) Patent No.: US 7,625,063 B2
(45) Date of Patent: Dec. 1, 2009

(54) APPARATUS AND METHODS FOR AN INKJET HEAD SUPPORT HAVING AN INKJET HEAD CAPABLE OF INDEPENDENT LATERAL MOVEMENT

(75) Inventors: John M. White, Hayward, CA (US); Fan Cheung Sze, San Jose, CA (US); Quanyuan Shang, Saratoga, CA (US); Shinichi Kurita, San Jose, CA (US); Hongbin Ji, Santa Clara, CA (US); Janusz Jozwiak, San Ramon, CA (US); Inchen Huang, Fremont, CA (US); Emanual Beer, San Jose, CA (US)

(73) Assignee: Applied Materials, Inc., Santa clara, CA (US)

( * ) Notice: Subject to any disclaimer, the term of this patent is extended or adjusted under 35 U.S.C. 154(b) by 853 days.

(21) Appl. No.: 11/019,967

(22) Filed: Dec. 22, 2004

(65) Prior Publication Data

US 2006/0092204 A1 May 4, 2006

Related U.S. Application Data

(60) Provisional application No. 60/625,550, filed on Nov. 4, 2004.

(51) Int. Cl.
*B41J 23/00* (2006.01)

(52) U.S. Cl. ..... 347/37; 347/40

(58) Field of Classification Search ..... 347/1–3, 347/37–40, 43–44, 32, 103, 106–107, 102; 400/55, 58, 59

See application file for complete search history.

(56) References Cited

U.S. PATENT DOCUMENTS

| | | | | |
|---|---|---|---|---|
| 3,968,498 | A * | 7/1976 | Uchiyama | 347/105 |
| 4,308,543 | A | 12/1981 | Shultz | |
| 4,571,601 | A | 2/1986 | Teshima | |
| 4,628,238 | A | 12/1986 | Smulders et al. | |
| 4,746,938 | A | 5/1988 | Yamamori et al. | |

(Continued)

FOREIGN PATENT DOCUMENTS

CN 1310669 A 8/2001

(Continued)

OTHER PUBLICATIONS

Search Report for Taiwan Application No. 094138870 issued Jun. 1, 2007.

(Continued)

*Primary Examiner*—Juanita D Stephens
(74) *Attorney, Agent, or Firm*—Dugan & Dugan, P.C.

(57) ABSTRACT

In a first aspect, a first apparatus is provided for inkjet printing. The first apparatus includes an inkjet head support that includes a plurality of inkjet heads. A first inkjet head of the plurality of inkjet heads is adapted to be independently moveable in both directions along a lateral axis relative to a second inkjet head of the plurality of inkjet heads. The first apparatus also includes a system controller adapted to control an independent lateral movement of the first inkjet head relative to the second inkjet head. Numerous other aspects are provided.

19 Claims, 4 Drawing Sheets

U.S. PATENT DOCUMENTS

| | | | | |
|---|---|---|---|---|
| 4,880,349 | A | 11/1989 | Woodward | |
| 4,987,043 | A | 1/1991 | Roosen et al. | |
| 5,114,760 | A | 5/1992 | Takemura et al. | |
| 5,144,330 | A * | 9/1992 | Bennett | 347/2 |
| 5,177,627 | A | 1/1993 | Ishiwata et al. | |
| 5,232,634 | A | 8/1993 | Sawada et al. | |
| 5,232,781 | A | 8/1993 | Takemura et al. | |
| 5,264,952 | A | 11/1993 | Fukutani et al. | |
| 5,340,619 | A | 8/1994 | Chen et al. | |
| 5,386,430 | A | 1/1995 | Yamagishi et al. | |
| 5,399,450 | A | 3/1995 | Matsushima et al. | |
| 5,432,538 | A | 7/1995 | Carlotta | |
| 5,552,192 | A | 9/1996 | Kashiwazaki et al. | |
| 5,554,466 | A | 9/1996 | Matsushima et al. | |
| 5,593,757 | A | 1/1997 | Kashiwazaki et al. | |
| 5,609,943 | A | 3/1997 | DeKoven et al. | 428/195.1 |
| 5,626,994 | A | 5/1997 | Takayanagi et al. | |
| 5,648,198 | A | 7/1997 | Shibata | |
| 5,702,776 | A | 12/1997 | Hayase et al. | |
| 5,705,302 | A | 1/1998 | Ohno et al. | |
| 5,714,195 | A | 2/1998 | Shiba et al. | |
| 5,716,739 | A | 2/1998 | Kashiwazaki et al. | |
| 5,716,740 | A | 2/1998 | Shiba et al. | |
| 5,726,724 | A | 3/1998 | Shirota et al. | |
| 5,748,266 | A | 5/1998 | Kodate | |
| 5,757,387 | A | 5/1998 | Manduley | |
| 5,788,384 | A | 8/1998 | Goodwin et al. | |
| 5,811,209 | A | 9/1998 | Eida et al. | |
| 5,817,441 | A | 10/1998 | Iwata et al. | |
| 5,831,704 | A | 11/1998 | Yamada et al. | |
| 5,847,735 | A | 12/1998 | Betschon | 347/86 |
| 5,880,799 | A | 3/1999 | Inoue et al. | |
| 5,888,679 | A | 3/1999 | Suzuki et al. | 430/7 |
| 5,895,692 | A | 4/1999 | Shirasaki et al. | |
| 5,916,713 | A | 6/1999 | Ochiai et al. | |
| 5,916,735 | A | 6/1999 | Nakashima et al. | |
| 5,922,401 | A | 7/1999 | Kashiwazaki et al. | |
| 5,948,576 | A | 9/1999 | Shirota et al. | |
| 5,948,577 | A | 9/1999 | Nakazawa et al. | |
| 5,956,063 | A | 9/1999 | Yokoi et al. | |
| 5,962,581 | A | 10/1999 | Hayase et al. | |
| 5,968,688 | A | 10/1999 | Masuda et al. | |
| 5,969,780 | A | 10/1999 | Matsumoto et al. | |
| 5,972,545 | A | 10/1999 | Eid et al. | 430/7 |
| 5,984,470 | A | 11/1999 | Sakino et al. | |
| 5,989,757 | A | 11/1999 | Satoi | |
| 6,013,415 | A | 1/2000 | Sakurai et al. | |
| 6,025,898 | A | 2/2000 | Kashiwazaki et al. | |
| 6,025,899 | A | 2/2000 | Fukunaga et al. | |
| 6,042,974 | A | 3/2000 | Iwata et al. | |
| 6,063,527 | A | 5/2000 | Nishikawa et al. | |
| 6,065,825 | A | 5/2000 | Anagnostopoulos et al. | |
| 6,066,357 | A | 5/2000 | Tang et al. | |
| 6,071,989 | A | 6/2000 | Sieber et al. | |
| 6,078,377 | A | 6/2000 | Tomono et al. | |
| 6,087,196 | A | 7/2000 | Sturm et al. | |
| 6,134,059 | A | 10/2000 | Shirota et al. | |
| 6,140,988 | A | 10/2000 | Yamada | |
| 6,142,604 | A | 11/2000 | Kanda et al. | |
| 6,145,981 | A | 11/2000 | Akahira et al. | 347/107 |
| 6,149,257 | A | 11/2000 | Yanaka et al. | 347/9 |
| 6,153,711 | A | 11/2000 | Towns et al. | |
| 6,154,227 | A | 11/2000 | Lund | 347/14 |
| 6,158,858 | A | 12/2000 | Fujiike et al. | |
| 6,158,946 | A | 12/2000 | Miyashita | |
| 6,162,569 | A | 12/2000 | Nakashima et al. | |
| 6,164,746 | A | 12/2000 | Akahira et al. | 347/15 |
| 6,196,663 | B1 | 3/2001 | Wetchler et al. | |
| 6,203,604 | B1 | 3/2001 | Kashiwazaki et al. | |
| 6,211,347 | B1 | 4/2001 | Sieber et al. | |
| 6,224,192 | B1 | 5/2001 | Robinson et al. | |
| 6,224,205 | B1 | 5/2001 | Akahira et al. | |
| 6,226,067 | B1 | 5/2001 | Nishiguchi et al. | |
| 6,228,435 | B1 | 5/2001 | Yoshikawa et al. | |
| 6,234,626 | B1 | 5/2001 | Axtell et al. | 347/108 |
| 6,242,139 | B1 | 6/2001 | Hedrick et al. | |
| 6,244,702 | B1 | 6/2001 | Sakino et al. | 347/106 |
| 6,264,322 | B1 | 7/2001 | Axtell et al. | 347/108 |
| 6,270,930 | B1 | 8/2001 | Okabe | |
| 6,271,902 | B1 | 8/2001 | Ogura et al. | |
| 6,277,529 | B1 | 8/2001 | Marumoto et al. | |
| 6,281,960 | B1 | 8/2001 | Kishimoto et al. | |
| 6,312,771 | B1 | 11/2001 | Kashiwazaki et al. | |
| 6,322,936 | B1 | 11/2001 | Nishikawa et al. | |
| 6,322,937 | B1 | 11/2001 | Drumm et al. | 430/7 |
| 6,323,921 | B1 | 11/2001 | Kurauchi et al. | |
| 6,327,034 | B1 | 12/2001 | Hoover et al. | |
| 6,331,384 | B1 | 12/2001 | Satoi | 430/347 |
| 6,341,840 | B1 | 1/2002 | van Doorn et al. | |
| 6,344,301 | B1 | 2/2002 | Akutsu et al. | |
| 6,356,357 | B1 | 3/2002 | Anderson et al. | |
| 6,358,602 | B1 | 3/2002 | Horiuchi et al. | |
| 6,367,908 | B1 | 4/2002 | Serra et al. | |
| 6,384,528 | B1 | 5/2002 | Friend et al. | |
| 6,384,529 | B2 | 5/2002 | Tang et al. | |
| 6,386,675 | B2 | 5/2002 | Wilson et al. | 347/19 |
| 6,392,728 | B2 | 5/2002 | Tanaka et al. | |
| 6,392,729 | B1 | 5/2002 | Izumi et al. | |
| 6,399,257 | B1 | 6/2002 | Shirota et al. | |
| 6,406,126 | B1 * | 6/2002 | Clark | 347/37 |
| 6,417,908 | B2 | 7/2002 | Nishiguchi et al. | |
| 6,424,393 | B1 | 7/2002 | Hirata et al. | |
| 6,424,397 | B1 | 7/2002 | Kuo | |
| 6,426,166 | B2 | 7/2002 | Nishikawa et al. | |
| 6,428,135 | B1 | 8/2002 | Lubinsky et al. | 347/11 |
| 6,428,151 | B1 | 8/2002 | Yi et al. | 347/68 |
| 6,429,601 | B1 | 8/2002 | Friend et al. | |
| 6,429,916 | B1 | 8/2002 | Nakata et al. | |
| 6,433,852 | B1 | 8/2002 | Sonoda et al. | |
| 6,450,635 | B1 | 9/2002 | Okabe et al. | |
| 6,455,208 | B1 | 9/2002 | Yamashiki et al. | |
| 6,462,798 | B1 | 10/2002 | Kim et al. | |
| 6,464,329 | B1 | 10/2002 | Koitabashi et al. | 347/40 |
| 6,464,331 | B1 | 10/2002 | van Doorn et al. | |
| 6,468,702 | B1 | 10/2002 | Yi et al. | |
| 6,471,317 | B2 | 10/2002 | Chang | |
| 6,471,335 | B1 | 10/2002 | Gelbart | |
| 6,471,352 | B2 | 10/2002 | Akahira | 347/106 |
| 6,475,271 | B2 | 11/2002 | Lin | |
| 6,476,888 | B2 | 11/2002 | Yamanashi | |
| 6,480,253 | B1 | 11/2002 | Shigeta et al. | |
| 6,498,049 | B1 | 12/2002 | Friend et al. | |
| 6,499,367 | B1 | 12/2002 | Saeki | |
| 6,508,533 | B2 | 1/2003 | Tsujimoto et al. | 347/30 |
| 6,518,700 | B1 | 2/2003 | Friend et al. | |
| 6,533,852 | B2 | 3/2003 | Hirose | |
| 6,554,398 | B2 | 4/2003 | Wyngaert et al. | |
| 6,557,984 | B2 | 5/2003 | Tanaka et al. | 347/65 |
| 6,569,706 | B2 | 5/2003 | Pakbaz et al. | |
| 6,580,212 | B2 | 6/2003 | Friend | |
| 6,582,048 | B1 | 6/2003 | Akahira et al. | |
| 6,627,364 | B2 | 9/2003 | Kiguchi et al. | |
| 6,630,274 | B1 | 10/2003 | Kiguchi et al. | |
| 6,667,795 | B2 | 12/2003 | Shigemura | 349/187 |
| 6,672,697 | B2 | 1/2004 | Haflinger | |
| 6,686,104 | B1 | 2/2004 | Shiba et al. | |
| 6,692,100 | B2 | 2/2004 | Steinfield et al. | |
| 6,692,983 | B1 | 2/2004 | Chen et al. | |
| 6,693,611 | B1 | 2/2004 | Burroughes | |
| 6,695,905 | B2 | 2/2004 | Rozumek et al. | |
| 6,698,866 | B2 | 3/2004 | Ward et al. | 347/43 |
| 6,705,694 | B1 | 3/2004 | Barbour et al. | 347/9 |
| 6,738,113 | B2 | 5/2004 | Yu et al. | |
| 6,762,234 | B2 | 7/2004 | Grizzi | |

| | | | | |
|---|---|---|---|---|
| 6,997,990 | B2 | 2/2006 | Bae et al. | |
| 7,014,309 | B2 | 3/2006 | Aukerman | |
| 7,413,272 | B2 | 5/2006 | Shamoun et al. | |
| 7,086,716 | B2 | 8/2006 | Steinfield et al. | |
| 7,104,535 | B2 | 9/2006 | Kurita et al. | |
| 7,172,841 | B2 | 2/2007 | Taniguchi et al. | |
| 7,182,429 | B2 | 2/2007 | Iwata | |
| 7,238,234 | B2 | 7/2007 | Bae et al. | |
| 7,247,339 | B2 | 7/2007 | Newsome et al. | |
| 7,255,421 | B2 | 8/2007 | Herwald et al. | |
| 7,271,824 | B2 | 9/2007 | Omori et al. | |
| 7,338,560 | B2 | 3/2008 | Byun et al. | |
| 2001/0012596 | A1 | 8/2001 | Kunimoto et al. | |
| 2002/0012022 | A1 | 1/2002 | Fassler et al. | |
| 2002/0051697 | A1 | 5/2002 | Ko et al. | |
| 2002/0054197 | A1 | 5/2002 | Okada et al. | 347/101 |
| 2002/0081376 | A1 | 6/2002 | Yonehara | |
| 2002/0122093 | A1 | 9/2002 | Otsuka | |
| 2002/0128515 | A1 | 9/2002 | Ishida et al. | |
| 2002/0144422 | A1 | 10/2002 | Suhara et al. | |
| 2003/0025446 | A1 | 2/2003 | Lin et al. | |
| 2003/0030715 | A1 | 2/2003 | Cheng et al. | |
| 2003/0039803 | A1 | 2/2003 | Burroughes | |
| 2003/0076454 | A1 | 4/2003 | Burroughes | |
| 2003/0108804 | A1 | 6/2003 | Cheng et al. | |
| 2003/0117455 | A1 | 6/2003 | Bruch et al. | |
| 2003/0118921 | A1 | 6/2003 | Chen et al. | |
| 2003/0164684 | A1 | 9/2003 | Green et al. | 313/582 |
| 2003/0164915 | A1 | 9/2003 | Fujiwara et al. | |
| 2003/0171059 | A1 | 9/2003 | Kawase et al. | |
| 2003/0189604 | A1 | 10/2003 | Bae et al. | 347/2 |
| 2003/0189606 | A1 | 10/2003 | Moon et al. | |
| 2003/0190419 | A1 | 10/2003 | Katagami et al. | |
| 2003/0218645 | A1 | 11/2003 | Dings et al. | |
| 2003/0222927 | A1 | 12/2003 | Koyama | |
| 2003/0222939 | A1 | 12/2003 | Gompertz | |
| 2003/0224621 | A1 | 12/2003 | Ostergard et al. | |
| 2004/0008243 | A1 | 1/2004 | Sekiya | 347/95 |
| 2004/0018305 | A1 | 1/2004 | Pagano et al. | 427/255.7 |
| 2004/0023567 | A1 | 2/2004 | Koyama et al. | 439/894 |
| 2004/0041155 | A1 | 3/2004 | Grzzi et al. | |
| 2004/0075383 | A1 | 4/2004 | Endo et al. | |
| 2004/0075789 | A1 | 4/2004 | Wang | |
| 2004/0086631 | A1 | 5/2004 | Han et al. | 427/27 |
| 2004/0094768 | A1 | 5/2004 | Yu et al. | |
| 2004/0097101 | A1 | 5/2004 | Kwong et al. | |
| 2004/0097699 | A1 | 5/2004 | Holmes et al. | |
| 2004/0104951 | A1 | 6/2004 | Shibata et al. | |
| 2004/0109051 | A1 | 6/2004 | Bright et al. | |
| 2004/0125181 | A1 | 7/2004 | Nakamura | 347/85 |
| 2004/0196329 | A1 | 10/2004 | Ready et al. | |
| 2004/0218002 | A1 | 11/2004 | Nakamura | |
| 2005/0041073 | A1 | 2/2005 | Fontaine et al. | |
| 2005/0057599 | A1 | 3/2005 | Takenaka et al. | |
| 2005/0072447 | A1 | 4/2005 | Aude | |
| 2005/0083364 | A1 | 4/2005 | Billow | |
| 2005/0156963 | A1 | 7/2005 | Song et al. | |
| 2005/0236975 | A1 | 10/2005 | Addington et al. | |
| 2005/0285896 | A1 | 12/2005 | Hori | |
| 2006/0073398 | A1 | 4/2006 | Kang et al. | |
| 2006/0092199 | A1 | 5/2006 | White et al. | |
| 2006/0092204 | A1 | 5/2006 | White et al. | |
| 2006/0092218 | A1 | 5/2006 | White et al. | |
| 2006/0092219 | A1 | 5/2006 | Kurita et al. | |
| 2006/0092436 | A1 | 5/2006 | White et al. | |
| 2006/0109290 | A1 | 5/2006 | Shamoun et al. | |
| 2006/0109296 | A1 | 5/2006 | Shamoun et al. | |
| 2007/0222817 | A1 | 9/2007 | Kurita et al. | |
| 2008/0018677 | A1 | 1/2008 | White et al. | |
| 2008/0026302 | A1 | 1/2008 | Shang et al. | |
| 2008/0186354 | A1 | 8/2008 | White | |
| 2008/0259101 | A1 | 10/2008 | Kurita et al. | |
| 2008/0291228 | A1 | 11/2008 | White et al. | |
| 2008/0309715 | A1 | 12/2008 | Shamoun et al. | |
| 2009/0058941 | A1 | 3/2009 | Kurita et al. | |

FOREIGN PATENT DOCUMENTS

| | | | |
|---|---|---|---|
| DE | 1 218 473 | | 6/1966 |
| EP | 0 675 385 | | 10/1995 |
| EP | 1 067 589 | A2 | 1/2001 |
| EP | 1 106 360 | | 6/2001 |
| EP | 1 392 449 | A0 | 3/2004 |
| EP | 1 557 270 | | 7/2005 |
| JP | 59-075205 | | 4/1984 |
| JP | 61-245106 | | 10/1986 |
| JP | 63-235901 | | 9/1988 |
| JP | 63-294503 | | 12/1988 |
| JP | 01-277802 | | 11/1989 |
| JP | 02-173704 | | 5/1990 |
| JP | 02-173703 | | 7/1990 |
| JP | 02-173704 | | 7/1990 |
| JP | 04-123006 | | 4/1992 |
| JP | 04149917 | | 5/1992 |
| JP | 05-224012 | | 9/1993 |
| JP | 06204321 | | 7/1994 |
| JP | 07-035915 | | 2/1995 |
| JP | 07-035916 | | 2/1995 |
| JP | 07-035917 | | 2/1995 |
| JP | 07-198924 | | 8/1995 |
| JP | 08-160219 | | 6/1996 |
| JP | 08313815 | | 11/1996 |
| JP | 09152569 | | 6/1997 |
| JP | 10-039130 | | 2/1998 |
| JP | 10-073813 | | 3/1998 |
| JP | 10-083760 | | 3/1998 |
| JP | 10-256346 | | 9/1998 |
| JP | 2001358202 | | 12/2001 |
| JP | 2002-277622 | | 9/2002 |
| JP | 2002308420 | | 10/2002 |
| JP | 2003-303544 | | 10/2003 |
| JP | 2004-077681 | | 3/2004 |
| JP | 06089845 | | 3/2004 |
| JP | 09090308 | | 4/2004 |
| JP | 2005-32685 | | 11/2005 |
| KR | 2004-0020902 | | 3/2004 |
| KR | 2006-98305 | | 9/2006 |
| TW | 519577 | | 2/2003 |
| WO | WO 93/24240 | A1 | 12/1993 |
| WO | WO00/68019 | | 11/2000 |
| WO | WO 02/14076 | | 2/2002 |
| WO | WO 03/022590 | | 3/2003 |
| WO | WO 03/045697 | | 6/2003 |

OTHER PUBLICATIONS

Office Action of China Application No. 2005101380598 (9521-CHI) dated Jan. 23, 2009.

Office Action of Taiwan Appliction No. I277526 (9521-Tai) dated Aug. 23, 2006.

Office Action of Korean Application No.: 10-2008-0003497 (11715-SK) dated Jun. 1, 2009.

* cited by examiner

APPARATUS AND METHODS FOR AN INKJET HEAD SUPPORT HAVING AN INKJET HEAD CAPABLE OF INDEPENDENT LATERAL MOVEMENT

The present application claims priority to commonly-assigned, co-pending U.S. Provisional Patent Application Ser. No. 60/625,550, filed Nov. 4, 2004 and entitled "APPARATUS AND METHODS FOR FORMING COLOR FILTERS IN A FLAT PANEL DISPLAY BY USING INKJETTING" which is hereby incorporated herein by reference in its entirety for all purposes.

CROSS REFERENCE TO RELATED APPLICATIONS

The present application is related to the following commonly-assigned, co-pending U.S. Patent Applications, each of which is hereby incorporated herein by reference in its entirety for all purposes:

U.S. patent application Ser. No. 11/019,929, filed Dec. 22, 2004 and titled "METHODS AND APPARATUS FOR INKJET PRINTING"; and U.S. Patent Application Ser. No.11/019,930, filed Dec. 22, 2004 and titled "METHODS AND APPARATUS FOR ALIGNING PRINT HEADS".

FIELD OF THE INVENTION

The present invention relates to electronic device manufacturing and, more particularly, to an apparatus and method for an inkjet head support which includes an inkjet head which is adapted for independent lateral movement.

BACKGROUND OF THE INVENTION

The flat panel display industry has been attempting to employ inkjet printing to manufacture display devices, in particular, color filters. One problem with effective employment of inkjet printing is that it is difficult to inkjet ink or other material accurately and precisely on a substrate while having high throughput. Accordingly, there is a need for improved methods and apparatus for efficiently positioning inkjet heads above drop locations on a substrate (e.g., so as to reduce the number of printing passes required for depositing ink on the substrate).

SUMMARY OF THE INVENTION

In a first aspect of the invention, a first apparatus is provided for inkjet printing. The first apparatus includes an inkjet head support that includes a plurality of inkjet heads. A first inkjet head of the plurality of inkjet heads is adapted to be independently moveable in both directions along a lateral axis relative to a second inkjet head of the plurality of inkjet heads. The first apparatus also includes a system controller adapted to control an independent lateral movement of the first inkjet head relative to the second inkjet head.

In a second aspect of the invention, a second apparatus is provided for inkjet printing. The second apparatus includes an inkjet head support that includes a plurality of inkjet heads. A first inkjet head of the plurality of inkjet heads is adapted to be independently moveable in both directions along a lateral axis relative to a second inkjet head of the plurality of inkjet heads. The first inkjet head is also adapted to be rotatable relative to the inkjet head support.

In a third aspect of the invention, a first method is provided for inkjet printing. The first method includes the steps of (1) providing an inkjet head support having a plurality of inkjet heads, wherein a first inkjet head of the plurality of inkjet heads is adapted to be independently moveable in both directions along a lateral axis relative to a second inkjet head of the plurality of inkjet heads; (2) independently moving the first inkjet head laterally relative to the second inkjet head; and (3) performing a printing operation on a substrate using the first inkjet head and the second inkjet head.

In a fourth aspect of the invention, a second method is provided. The second method includes the steps of (1) performing a first printing pass on a first display object of a substrate by simultaneously passing a plurality of inkjet heads over the first display object and using the plurality of inkjet heads to print ink on the first display object; (2) laterally displacing a first of the plurality of inkjet heads from a position for printing on the first display object to a position for printing on a second display object on the substrate; and (3) simultaneously performing a second printing pass on the first display object and a first printing pass on the second display object by using the first inkjet head to print ink on the second display object and at least a second of the plurality of inkjet heads to print ink on the first display object. Numerous other aspects are provided in accordance with these and other aspects of the invention.

Other features and aspects of the present invention will become more fully apparent from the following detailed description, the appended claims and the accompanying drawings.

DETAILED DESCRIPTION

Figure 1:
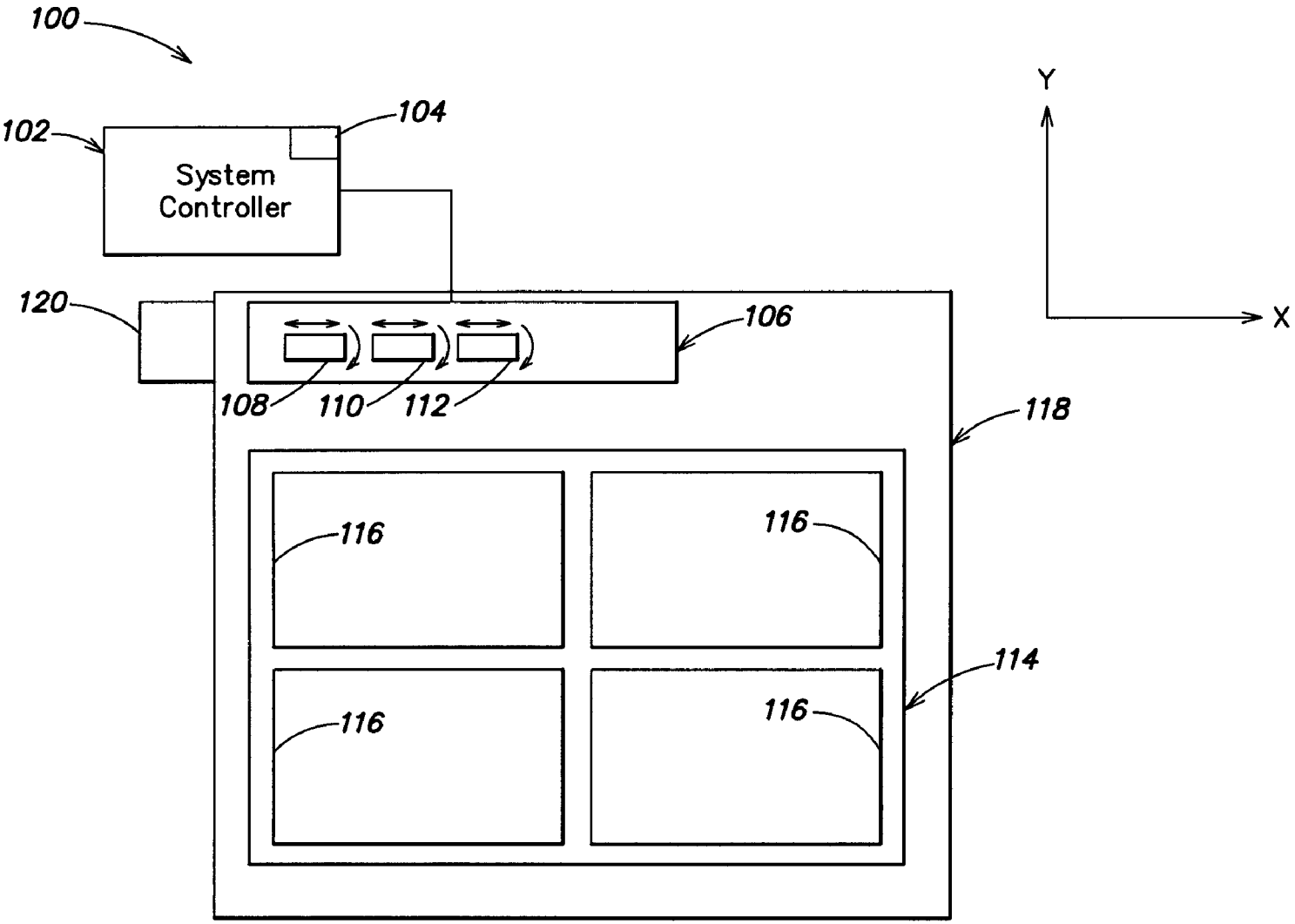
FIG. 1 illustrates at top view of an apparatus for inkjet printing in accordance with an embodiment of the present invention.

The present invention relates to electronic device manufacturing and, more particularly, to apparatus and methods for an inkjet head support which includes an inkjet head which is adapted for independent lateral movement in either direction relative to another inkjet head. In an exemplary embodiment, the inkjet head support includes two or more inkjet heads. Each inkjet head is mounted to the inkjet head support. In one or more exemplary embodiments, each inkjet head on the inkjet head support is adapted to be moveable independently in one or more lateral directions relative to any other inkjet head on the inkjet head support. Further, each inkjet head can be rotatable relative to the inkjet head support. The present invention may be particularly useful in manufacturing color filters for flat panel displays that use organic light emitting diode (OLED) and/or polymer light emitting diode (PLED) technologies.

In one exemplary embodiment, three inkjet heads can be utilized. Each inkjet head can print any color ink. For example, a respective inkjet head can be used for printing red ink, green ink, and/or blue ink. Each inkjet head can also be used for printing other color inks, such as, but not limited to, Cyan, Yellow, Magenta, White, and/or Clear inks. In some embodiments, each inkjet head is used to print a different color ink.

In another exemplary embodiment, any number of inkjet heads can be utilized.

The operation and movement of the inkjet printing heads can be controlled by a system controller. The system controller can control the movement of each inkjet head in one or more lateral directions. The system controller can also control the rotation of each inkjet head relative to the other inkjet heads and to the inkjet head support.

Independent lateral movement can be effectuated for more than one inkjet head simultaneously and/or sequentially. Simultaneous and/or sequential rotation of more than one inkjet head can also be effectuated by the present invention. For example, the system controller, in processing a compound movement command or a compound movement program or subroutine, can cause the independent lateral movement and/or rotation of two or more inkjet heads.

The present invention provides for a number of advantages. For example, the present invention can be utilized to simultaneously deposit inks on more than one display object of a substrate. Display objects may include color filters for flat panel displays. The present invention can also be utilized to provide for a more effective, independent alignment of inkjet heads relative to a single display object and/or multiple display objects. The ability to provide independent inkjet head alignment relative to one or more display objects and the ability to perform printing operations on more than one display object simultaneously serves to reduce the number of inkjet printing passes required for a print operation for a given substrate. The present invention is particularly useful for the simultaneous printing of multiple color filter display objects on a single substrate.

The present invention also provides apparatus and methods which allow for an inkjet head to be moved relative to one or more of the other inkjet heads so that certain maintenance steps, head cleaning, head wiping, etc., can be performed on the inkjet head while other inkjet heads on the inkjet head support continue to print.

FIG. 1 illustrates at top view of the apparatus of the present invention which is designated generally by the reference numeral 100. The apparatus 100 of the present invention, in an exemplary embodiment, includes a system controller 102, an image file database 104 which can be an integral component of the system controller 102 or which can be an external device. The apparatus 100 also includes an inkjet head support 106. The system controller 102 is coupled to the inkjet head support 106.

In the exemplary embodiment of FIG. 1, the inkjet head support 106 includes and/or is coupled to three inkjet jet heads which from left to right are designated by the reference numerals 108, 110, and 112, respectively. Although only three inkjet heads are shown as being utilized, it is important to note that any number of inkjet heads can be mounted on and/or used in connection with the inkjet head support 106.

Each of the inkjet heads 108, 110, and 112, can print any color ink. In an exemplary embodiment, a respective inkjet head can be used for printing Red ink, Green ink, and/or Blue ink. Each inkjet head can also be used for printing other color inks, such as, but not limited to, Cyan, Yellow, Magenta, White, and/or Clear inks.

In one or more exemplary embodiments, each of the inkjet heads 108, 110, and 112, can be independently moveable in one or more lateral directions relative to another of the inkjet heads 108, 110, and 112. In another exemplary embodiment, each of the inkjet heads 108, 110, and 112, can be rotatable independently relative to the inkjet head support 106. In yet another embodiment, the inkjet heads 108, 110, and 112 can be independently moveable in one or more vertical directions (e.g., along a z-axis) away from or toward a substrate 114. Further, the lateral movement, rotation, and vertical movement can be performed independently, in any sequence, and/or substantially simultaneously.

The system controller 102 can be coupled to the inkjet head support 106 and to each of the inkjet heads 108, 110, and 112 so as to control and monitor the operation and movement of the inkjet head support 106 and each of the inkjet heads 108, 110, and 112.

FIG. 1 also shows a substrate 114, such as a substrate used in manufacturing flat panel displays which involve an inkjetting process in their manufacture. In FIG. 1, the substrate 114 is shown containing a plurality of display objects 116. In general, the substrate 114 can contain one or more display devices 116.

The substrate 114 is supported by a stage 118 and is moved under the inkjet head support 106 by the stage 118. The stage 118 is coupled to the system controller 102, which can control movement of the stage in both the X-axis direction and the Y-axis direction.

The system controller 102 can be any suitable computer or computer system, including, but not limited to a mainframe computer, a minicomputer, a network computer, a personal computer, and/or any suitable processing device, component, or system. The system controller 102, an exemplary embodiment, can control the lateral movement of the inkjet heads 108, 110, and 112 in both directions as illustrated by the arrows. The system controller 102 can also control the rotation of each of the inkjet heads 108, 110, and 112 relative to the inkjet head support 106.

In an exemplary embodiment, the image file database 104 contains data and/or information regarding any of the substrate 114 and/or display objects 116 which can be manufactured with the apparatus 100. The image file database 104 can, for example, include information which can be utilized by the system controller 102 to control the movement as well as the printing operations of each of the inkjet heads 108, 110, and 112 and the stage 118, so as to perform any and/or all requisite printing passes over the display objects 116 and/or the substrate 114. The system controller 102 can, for example, control the entire printing operation on and for any given display object 116 and/or substrate 114 by utilizing information stored in the image file database 104.

Figure 2A:
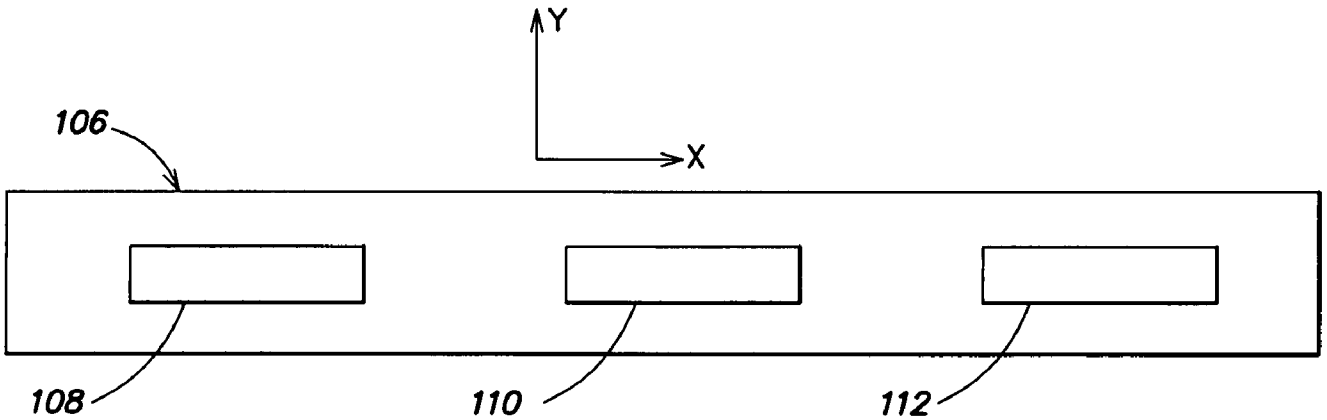
FIG. 2A shows a top view of an inkjet head support showing inkjet heads in an initial orientation in accordance with an embodiment of the present invention.

FIG. 2A shows a top view of the inkjet head support 106 showing each of the inkjet heads 108, 110, and 112, in an initial orientation. As shown in FIG. 2A, each of the inkjet heads 108, 110, and 112 are oriented so that they are in alignment with one another in the X-axis lateral direction. In an exemplary embodiment, each of the inkjet heads 108, 110, and 112 can be positioned a pre-determined distance from an adjacent inkjet head so as to allow sufficient room for each inkjet head to be moved laterally in both directions as well as to be rotated in order to perform any and/or all of the printing operations described herein. In one exemplary embodiment, the inkjet heads 108, 110, and 112 can be spaced by about 100 mm, although other spacings may be used.

Each of the inkjet heads 108, 110, and 112 can also be positioned a pre-determined distance from an adjacent inkjet head so as to allow adjacent inkjet heads to perform printing operations on different display objects 116 on the substrate 114 in a single Y-axis print pass of the inkjet head support 106 over the substrate 114 and respective display objects (as described further below).

Figure 2B:
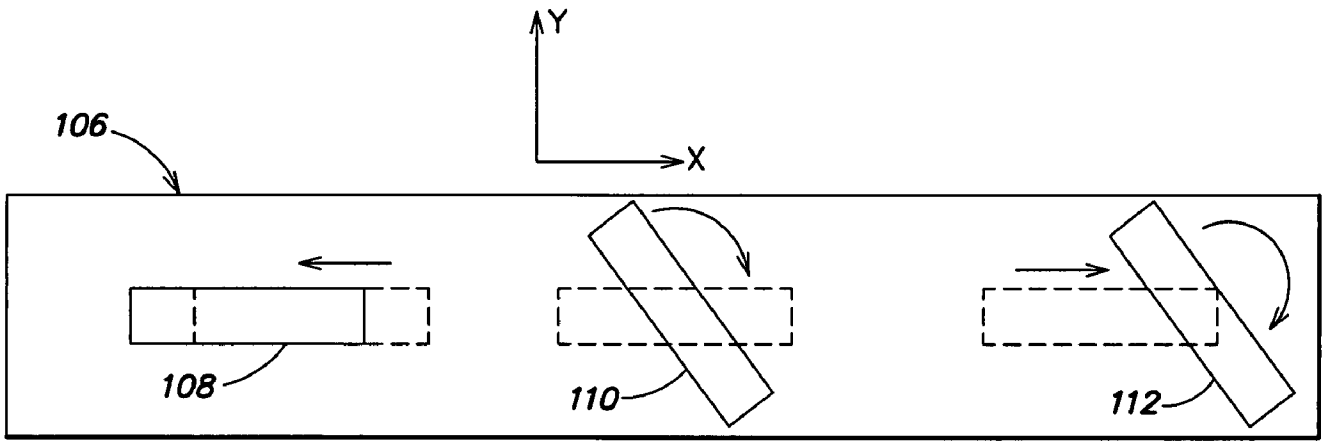
FIG. 2B shows a top view of the inkjet head support of FIG. 2A showing each of the respective inkjet heads in a position subsequent to being laterally moved or displaced relative to an inkjet head and/or rotated relative to the inkjet head support.

FIG. 2B shows a top view of the inkjet head support 106 of FIG. 2A showing each of the respective inkjet heads 108, 110, and 112, in a position subsequent to being laterally moved or displaced relative to an inkjet head and/or rotated relative to the inkjet head support 106.

In FIG. 2B, the initial positions of each of the inkjet heads 108, 110, and 112 are illustrated by dotted lines as shown. With reference to FIG. 2B, the inkjet head 108 has been moved laterally to the left of an initial position and has been moved laterally relative to each of inkjet head 110 and inkjet head 112. FIG. 2B shows inkjet head 110 has been rotated in the direction shown by the arrow relative to the inkjet head support 106. In the position shown, it is noted that inkjet 110 was not moved laterally, but simple rotated relative to the inkjet head support 106.

FIG. 2B also shows inkjet head 112 has been moved laterally to the right of its initial position and relative to each of inkjet head 108 and inkjet head 110. FIG. 2B also depicts inkjet head 112 as having been rotated in the direction shown by the arrow relative to inkjet head support 106. It is important to note that any lateral movement, any vertical movement, and/or any rotation of the respective inkjet head can occur independently, in any order, and/or substantially simultaneously. For example, a respective inkjet head can be (1) laterally moved and thereafter rotated; (2) a respective inkjet head can be rotated and thereafter laterally moved; and/or (3) a respective inkjet head can be simultaneously rotated and laterally moved. Similarly, vertical movement of an inkjet head can be performed before, after or during lateral movement and/or rotation of the inkjet head. In any case, the lateral motion, vertical motion and/or rotation can occur while the remaining inkjet heads are held stationary.

In another exemplary embodiment, the inkjet head support 106 can be moved in both an X-axis direction of movement and a Y-axis direction of movement. In this regard, once inkjet heads have been laterally moved and/or rotated to a given position and/or angular orientation, the inkjet head support 106 can effect the movement or passing of the positioned and/or oriented inkjet heads over the respective display objects 116 so as to effectuate an ink printing operation on the display objects 116.

The system controller 102, in an exemplary embodiment, can control and/or monitor any movement, and/or rotation, and/or print operation, of each of the inkjet heads 108, 110, and 112, and can control and/or monitor any movement and/or print operation of the inkjet head support 106.

Figure 3:
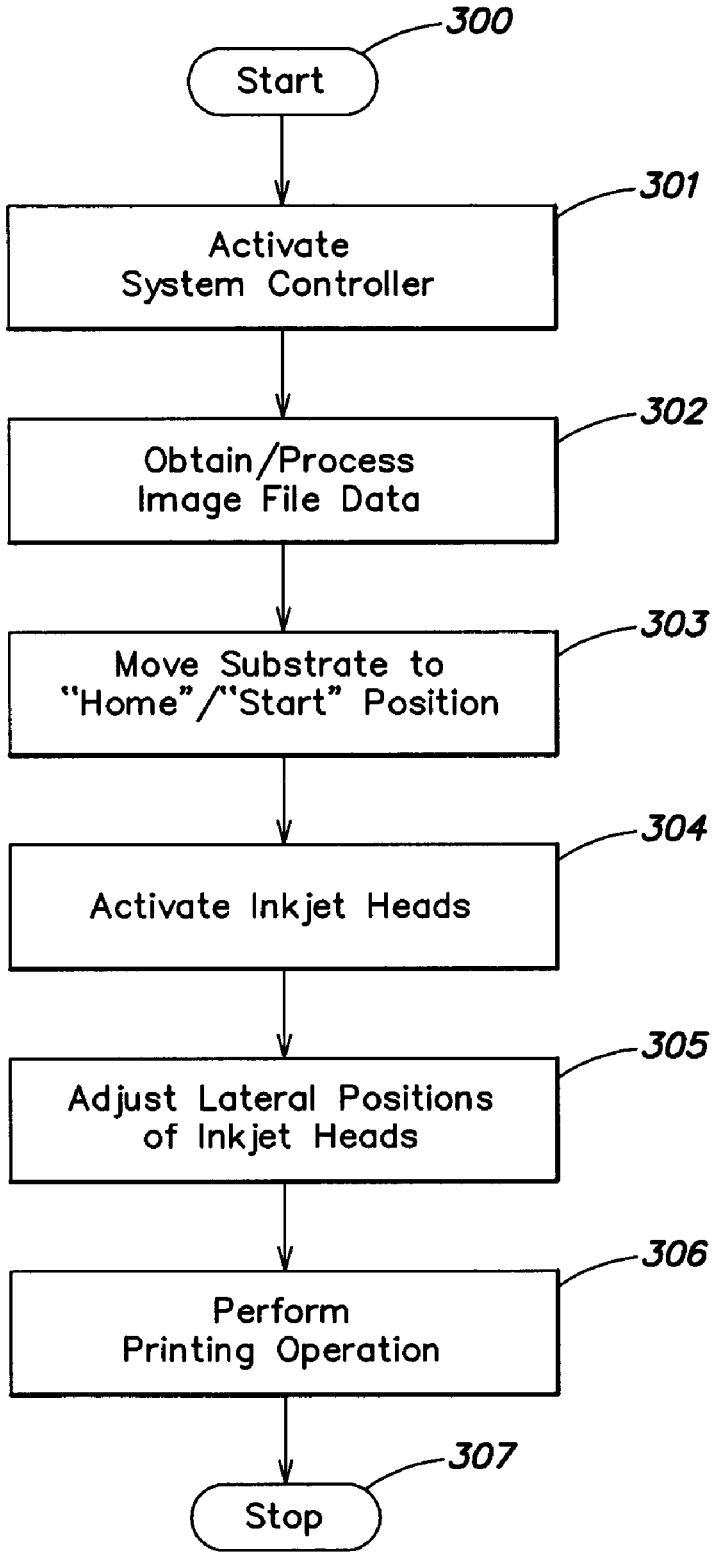
FIG. 3 is a flowchart of an exemplary printing operation using the apparatus of the present invention.

FIG. 3 is a flowchart of an exemplary embodiment printing operation using the apparatus 100 of the present invention. Once a substrate 114 containing a display object(s) 116 is placed on the stage 118 of the printing chamber (not shown), the operation of the apparatus 100 can commence at step 300. At step 301, the system controller 102 is activated. At step 302, the system controller 102 can obtain image file data for the substrate to be processed from the image file database 104. At step 302, the system controller can also process the image file data for the substrate 114.

At step 303, the system controller 102 moves substrate 114 and/or the inkjet head support 106 to the "home" or "start" position for the substrate 114. For example, the stage 118 can be moved to a home or start position. Likewise, if the stage 118 remains stationary while the head support 106 moves, the head support 106 can be moved to a home or start position. At step 304, the system controller 102 activates each of the inkjet heads 108, 110, and 112 (e.g., by supplying ink to the inkjet heads or otherwise readying the inkjet heads for printing).

At step 305, the system controller 102 commences the printing process by adjusting the lateral positions of each of the inkjet heads 108, 110, and 112 (e.g., for proper positioning during printing of ink into the display pixels and/or display subpixels of a display object). During this step, the system controller 102 can also rotate any one of the inkjet heads 108, 110, 112, and/or each of the inkjet heads so as to provide for their proper angle of orientation for the substrate 114.

At step 306, the system controller 102 commences the print passing operation of the inkjet head support 106 and each of the inkjet heads 108, 110, and 112. The print passing operation can include passing the substrate 114 below the inkjet head support 106 in the Y-axis direction from a starting edge to a stopping edge so as to print ink in all applicable display pixels and/or display subpixels on one or more display object 116 on the substrate 114.

In an exemplary embodiment, the stage 118 is moved such that the inkjet head support 106 performs a complete pass in the Y-axis direction from the starting edge of the substrate 114 to the stopping edge of the substrate 114. The stage 118 can then shift laterally and/or return the substrate 114 to the starting edge, whereat, any of the inkjet heads 108, 110, and 112, can be moved laterally and independently so that each inkjet head is in the proper location for the next printing pass.

The above process can repeat until the printing operation is performed for the entire substrate 114. That is, the printing operation at step 306 continues under the control of the system controller 102 (e.g., based on the image file data) until the printing process has been complete for the substrate 114. Thereafter, the operation ceases at step 307.

In instances where an inkjet head is finished passing over a display object, that inkjet head can be independently moved laterally to a printing pass position for the next display object 116 on the substrate 114 as described further below with reference to FIGS. 4A-4D. In this manner, the inkjet head support 106 can straddle two or more display objects 116 in one pass.

Figure 4A:
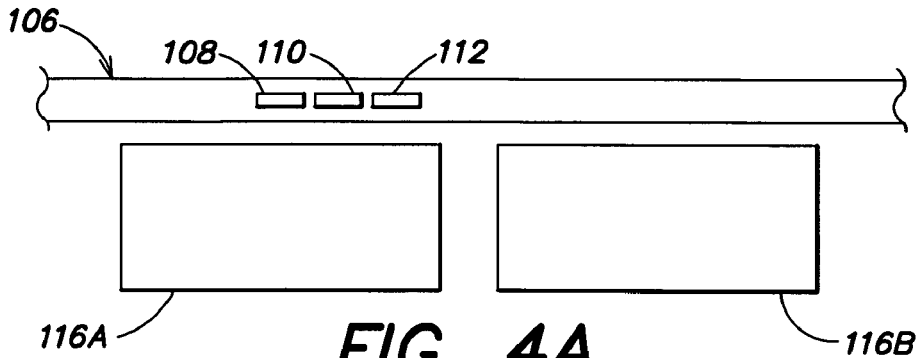
FIGS. 4A through 4D illustrate simplified top views of the apparatus of FIGS. 1-2B during an exemplary step 306 of the flowchart of FIG. 3.
Figure 4B:
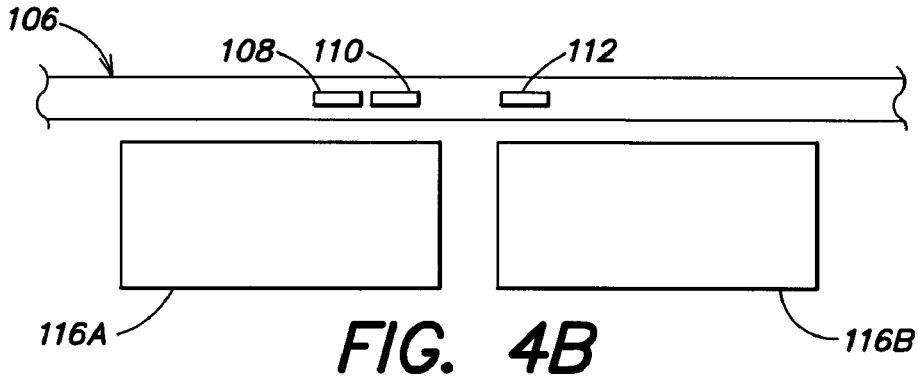

FIGS. 4A through 4D illustrate simplified top views of the apparatus 100 during an exemplary step 306 of the flowchart of FIG. 3. In FIG. 4A, all of the inkjet heads 108, 110, and 112, are positioned for a printing pass on the leftmost display object 116A. Upon completing a printing pass of the leftmost object 116A, the inkjet head 112 is laterally moved independently relative to each of inkjet heads 108 and 110 so that inkjet head 112 is positioned for a printing pass of the rightmost display object 116B as shown in FIG. 4B. That is, the inkjet head 112 can print on the rightmost display object 116B during the same printing pass that the inkjet heads 108, 110 print on the leftmost display object 116.

Figure 4C:
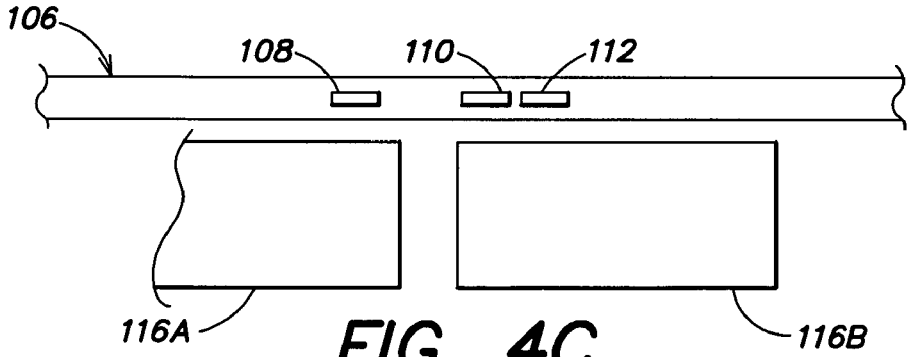
Figure 4D:
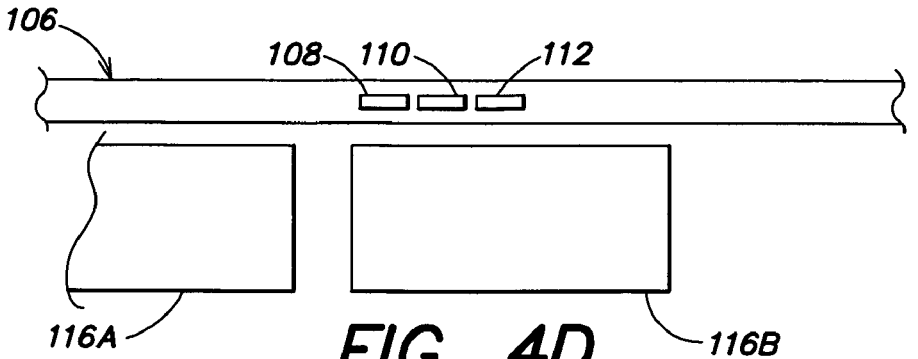

After inkjet head 110 has performed a final printing pass over the leftmost display object 116A, inkjet head 110 is laterally moved independently relative to each of inkjet heads 108 and 112 toward inkjet head 112 so that it is positioned for a printing pass over the rightmost display object 116B as shown in FIG. 4C. Thereafter, during the same printing pass, the inkjet head 108 can print on the leftmost display object 116A while the inkjet heads 110, 112 print on the rightmost display object 116B. After inkjet head 108 has performed its last printing pass over the leftmost display object 116A, the inkjet head 108 can be moved to the right so that the inkjet head 108 is positioned for a first printing pass over the rightmost display object 116B as shown in FIG. 4D. The inkjet heads 108, 110, 112 then can print on the rightmost display object 116B during any subsequent printing pass.

The system controller 102 can control and activate the independent lateral movement of each of the inkjet heads 108, 110, and 112. By moving an inkjet head laterally and independently of another inkjet head, the apparatus 100 allows for maximum printing operations in a minimum number of printing passes.

The apparatus 100 of the present invention can dispense ink without having to shut down an inkjet head when the inkjet head has completed its printing of a first display object. Instead, the apparatus 100 effectuates the independent lateral movement of the inkjet head to the next laterally displaced display object on the substrate while the remaining inkjet heads complete their printing operations on the first display object.

The apparatus 100 can also perform compound commands for the inkjet heads 108, 110 and 112. Compound commands can be utilized when two or more of the inkjet heads are moved laterally independently of another inkjet head. For example, when the leftmost inkjet head 108 is performing its last printing pass on a display object, in a left to right printing operation, the middle inkjet head 110 and the rightmost inkjet head 112 may be performing a printing pass on a laterally displaced display object (as described above). After the inkjet head 108 completes its last printing pass on the display object, the inkjet head 108 will be moved to a position so as to perform a printing pass on the laterally displaced display object which was being printed on by the inkjet heads 110 and 112 (e.g., a display object to the right of the display object on which the inkjet head 108 was printing).

If required, a compound command can be utilized wherein, before inkjet head 108 is moved to the right display object, the inkjet head 112 is first moved independently and laterally away from the inkjet head 108. Thereafter, the inkjet head 110 is moved laterally and independently away from the inkjet head 108. The inkjet heads 110, 112 also can be simultaneously moved away from the inkjet 108 if required.

In another exemplary embodiment, the apparatus 100 can perform any of the herein-described lateral independent movements of an inkjet head 108, 110, and/or 112 so as to allow for the moving of the respective head or heads to a location 120 where a maintenance, head cleaning, head wiping or other similar operation can be performed on the respective inkjet head. A compound command, wherein two or more inkjet heads can be sequentially or simultaneously moved laterally, can also be performed prior to or to facilitate a maintenance operation on one or more of the inkjet heads.

The foregoing description discloses only particular embodiments of the invention; modifications of the above disclosed methods and apparatus which fall within the scope of the invention will be readily apparent to those of ordinary skill in the art. For example, in some embodiments, the apparatus and methods of the present invention may be applied to semiconductor processing and/or electronic device manufacturing. For example, resist patterns may be jetted onto substrates which may include glass, polymers, semiconductors, and/or any other suitable materials that are practicable. Thus, the jetted material may include ink, polymers, or any other suitable material that is practicable.

Accordingly, while the present invention has been disclosed in connection with specific embodiments thereof, it should be understood that other embodiments may fall within the spirit and scope of the invention, as defined by the following claims.

The invention claimed is:

1. An inkjet printing apparatus, comprising:

an inkjet head support, wherein the inkjet head support further comprises:

a plurality of inkjet heads, wherein a first inkjet head of the plurality of inkjet heads is independently moveable in both directions along a lateral axis relative to a second inkjet head of the plurality of inkjet heads; and a system controller, wherein the system controller is configured to control an independent lateral movement of the first inkjet head relative to the second inkjet head.

2. The inkjet printing apparatus of claim 1, wherein the inkjet head support is moveable in an X-axis direction and in a Y-axis direction.

3. The inkjet printing apparatus of claim 1, wherein the inkjet head support contains three inkjet heads.

4. The inkjet printing apparatus of claim 1, wherein each inkjet head of the plurality of inkjet heads can print at least one of Red ink, Green ink, Blue ink, Cyan ink, yellow ink, Magenta ink, White ink, and Clear ink.

5. The inkjet printing apparatus of claim 1, wherein at least one inkjet head of the plurality of inkjet heads is rotatable relative to the inkjet head support.

6. The apparatus of claim 5, wherein the first inkjet head is rotatable relative to the inkjet head support.

7. The apparatus of claim 5, wherein the system controller is configured to control a rotation of the at least one inkjet head of the plurality of inkjet heads.

8. The apparatus of claim 1, wherein the system controller is configured to control a movement of two or more inkjet heads simultaneously.

9. The apparatus of claim 1, wherein the system controller is configured to control a movement of two or more inkjet heads sequentially.

10. The apparatus of claim 1, wherein the apparatus is configured to simultaneously print ink on a plurality of laterally displaced display objects located on a substrate.

11. The apparatus of claim 1, further comprising:

means for performing at least one of an inkjet maintenance operation, a head cleaning operation, and a head wiping operation, on at least one inkjet head of the plurality of inkjet heads.

12. The apparatus of claim 1, wherein the system controller is configured to at least one of adjust a lateral position of and rotate an inkjet head of the plurality of inkjet heads prior to a printing operation.

13. The apparatus of claim 12, wherein the system controller is configured to at least one of adjust a lateral position of and rotate an inkjet head of the plurality of inkjet heads based on information obtained from an image data file.

14. The apparatus of claim 1, wherein the system controller is configured to move at least one inkjet head of the plurality of inkjet heads to a location where a maintenance operation can be performed on the at least one inkjet head.

15. An inkjet printing apparatus, comprising:

an inkjet head support, wherein the inkjet head support further comprises:

a plurality of inkjet heads, wherein a first inkjet head of the plurality of inkjet heads is independently moveable in both directions along a lateral axis relative to a second inkjet head of the plurality of inkjet heads, and further wherein the first inkjet head is rotatable relative to the inkjet head support.

16. The inkjet printing apparatus of claim 15, wherein the inkjet head support contains three inkjet heads.

17. The apparatus of claim 15, further comprising:

a system controller, wherein the system controller is configured to control an independent lateral movement of the first inkjet head relative to the second inkjet head.

18. The apparatus of claim 15, further comprising:

a system controller, wherein the system controller is configured to control a rotation of the first inkjet head relative to the inkjet head support.

19. The apparatus of claim 15, further comprising:

a system controller, wherein the system controller is configured to control a print operation of at least one of the first inkjet head and the second inkjet head.

* * * * *

UNITED STATES PATENT AND TRADEMARK OFFICE

CERTIFICATE OF CORRECTION

PATENT NO. : 7,625,063 B2
APPLICATION NO. : 11/019967
DATED : December 1, 2009
INVENTOR(S) : White et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1150 days.

Signed and Sealed this

Twenty-sixth Day of October, 2010

David J. Kappos

David J. Kappos
*Director of the United States Patent and Trademark Office*